US010037845B2

(12) United States Patent
Kim

(10) Patent No.: US 10,037,845 B2
(45) Date of Patent: Jul. 31, 2018

(54) VARIABLE INDUCTOR AND METHOD FOR MANUFACTURING THE SAME

(71) Applicant: Dong-hun Kim, Buk-gu Daegu (KR)

(72) Inventor: Dong-hun Kim, Buk-gu Daegu (KR)

( * ) Notice: Subject to any disclaimer, the term of this patent is extended or adjusted under 35 U.S.C. 154(b) by 0 days.

(21) Appl. No.: 15/322,974

(22) PCT Filed: Jul. 1, 2015

(86) PCT No.: PCT/KR2015/006760
§ 371 (c)(1),
(2) Date: Dec. 29, 2016

(87) PCT Pub. No.: WO2016/003190
PCT Pub. Date: Jan. 7, 2016

(65) Prior Publication Data

US 2017/0140868 A1 May 18, 2017

(30) Foreign Application Priority Data

Jul. 1, 2014 (KR) ..... 10-2014-0081734

(51) Int. Cl.
*H01F 27/24* (2006.01)
*H01F 29/10* (2006.01)
(Continued)

(52) U.S. Cl.
CPC ..... *H01F 29/10* (2013.01); *H01F 27/24* (2013.01); *H01F 27/25* (2013.01); *H01F 27/255* (2013.01);
(Continued)

(58) Field of Classification Search
CPC ..... H01F 27/00–27/36
(Continued)

(56) References Cited

U.S. PATENT DOCUMENTS 3,518,595 A * 6/1970 Dawson ..... H01F 27/004 324/207.16
4,531,108 A * 7/1985 Brandes ..... H01F 27/245 336/178
(Continued)

FOREIGN PATENT DOCUMENTS

CN 1473337 A 2/2004
CN 102543373 A 7/2012
(Continued)

OTHER PUBLICATIONS

Japanese Office Action dated Oct. 3, 2017 for Japanese application No. 2016-573060.
(Continued)

*Primary Examiner* — Tuyen Nguyen
(74) *Attorney, Agent, or Firm* — Ohlandt, Greeley, Ruggiero & Perle, LLP

(57) ABSTRACT

A variable inductor of which variable inductance characteristics can be adjusted is provided. The inductor includes: a magnetic core having a preset shape; and a coil part surrounding a portion of the magnetic core and generating a magnetic flux depending on a current flow, wherein the magnetic core includes a first magnetic region formed of a first magnetic material and a second magnetic region formed of a second magnetic material different from the first magnetic material.

12 Claims, 22 Drawing Sheets

(51) Int. Cl.

| | |
|---|---|
| ***H01F 27/25*** | (2006.01) |
| ***H01F 27/255*** | (2006.01) |
| ***H01F 27/28*** | (2006.01) |
| ***H01F 27/42*** | (2006.01) |
| ***H01F 41/02*** | (2006.01) |
| ***H01F 41/064*** | (2016.01) |

(52) U.S. Cl.
CPC ..... *H01F 27/2823* (2013.01); *H01F 27/42* (2013.01); *H01F 41/0206* (2013.01); *H01F 41/064* (2016.01)

(58) Field of Classification Search
USPC .... 336/65, 83, 178, 212, 220–223, 232–234
See application file for complete search history.

(56) References Cited

U.S. PATENT DOCUMENTS

| | | | | |
|---|---|---|---|---|
| 6,674,320 | B2 * | 1/2004 | Duffy | H01F 29/14 327/555 |
| 6,856,231 | B2 | 2/2005 | Fujiwara et al. | |
| 6,995,643 | B2 | 2/2006 | Fujiwara et al. | |
| 7,501,925 | B2 * | 3/2009 | Naito | C22C 33/0207 148/304 |
| 7,889,040 | B2 * | 2/2011 | Viitanen | H01F 3/14 336/110 |
| 8,749,332 | B1 * | 6/2014 | Hu | H02M 3/285 336/10 |
| 9,019,062 | B2 | 4/2015 | Hejny | |
| 2002/0149458 | A1 | 10/2002 | Fujiwara et al. | |
| 2004/0239463 | A1 * | 12/2004 | Poniatowski | H01F 27/38 336/10 |
| 2005/0116804 | A1 | 6/2005 | Fujiwara et al. | |
| 2012/0200382 | A1 | 8/2012 | Hejny | |
| 2013/0043969 | A1 | 2/2013 | Ota et al. | |

FOREIGN PATENT DOCUMENTS

| | | | |
|---|---|---|---|
| CN | 1025543373 | A | 7/2012 |
| JP | 4311390 | Y1 | 5/1968 |
| JP | S5796512 | A | 6/1982 |
| JP | 57188302 | U | 11/1982 |
| JP | 594618 | U | 1/1984 |
| JP | S63228605 | A | 3/1988 |
| JP | S632288605 | A | 3/1988 |
| JP | H01125809 | A | 5/1989 |
| JP | 05121239 | A | 5/1993 |
| JP | 07220933 | A | 8/1995 |
| JP | H11144983 | A | 5/1999 |
| JP | 2002222714 | A | 8/2002 |
| JP | 2003068535 | A | 3/2003 |
| JP | 2003109832 | A | 4/2003 |
| JP | 2005303019 | A | 10/2005 |
| JP | 2007012647 | A | 1/2007 |
| JP | 2009158534 | A | 7/2009 |
| JP | 2010278273 | A | 12/2010 |
| JP | 2011199227 | A | 10/2011 |
| JP | 2013042027 | A | 2/2013 |
| KR | 101223607 | B1 | 1/2013 |

OTHER PUBLICATIONS

International Search Report dated Oct. 5, 2015 for PCT application No. PCT/KR2015/006760.
Written Opinion dated Oct. 5, 2015 for PCT application No. PCT/KR2015/006760.
Chinese Office Action dated Jan. 17, 2018 for Chinese application No. 201580036146.4.
Japanese Office Action dated May 15, 2018 for Japanese application No. 2016-573060.

* cited by examiner

VARIABLE INDUCTOR AND METHOD FOR MANUFACTURING THE SAME

CROSS-REFERENCE TO RELATED APPLICATIONS

This application claims priority from Korean Patent Application No. 10-2014-0081734, filed on Jul. 1, 2014, in the Korean Intellectual Property Office, the disclosure of which is incorporated herein by reference in its entirety.

BACKGROUND OF THE INVENTION

Field of the Invention

Apparatuses and methods consistent with the present disclosure relate to a variable inductor and a method for manufacturing the same, and more particularly, to an inductor of which magnetic saturation characteristics may be widely adjusted, and a method for manufacturing the same.

Description of the Related Art

An inductor means a passive element manufactured by winding an electric wire around a core. The inductor uses a feature that energy is stored in a magnetic field generated by a current. An inductance, which is a ratio between a current change rate depending on a time and a voltage applied across the inductor, is an inherent constant of the inductor. The inductance may be changed depending on a material and a shape of the inductor.

An inductance of a general inductor is a constant. Therefore, the general inductor has a constant inductance value in a relationship with a current until a core of the inductor is saturated. These characteristics have a disadvantage in that power conversion efficiency of a high power converter is not good due to characteristics of a variable load.

In addition, in a conventional variable inductor according to the related art, it is required to use a mechanical tap in a main winding or an auxiliary winding having a separate power driving device for supplying an additional magnetic flux is required. Further, in the variable inductor according to the related art, an additional circuit for sensing a current for a load is required. Therefore, when the variable inductor according to the related art is used, disadvantages such as a decrease in power conversion efficiency and economical efficiency and an increase in a volume and circuit complexity are caused.

Therefore, an inductor capable of overcoming limitations of the variable inductor according to the related art and easily implementing characteristics of the variable inductor, and a method for manufacturing the same have been demanded.

SUMMARY OF THE INVENTION

Exemplary embodiments of the present invention can overcome the above disadvantages and other disadvantages not described above.

The present disclosure provides an inductor having saturation characteristics varied depending on a current by including magnetic cores formed of heterogeneous magnetic materials, and a method for manufacturing the same.

According to an aspect of the present disclosure, an inductor includes: a magnetic core having a preset shape; and a coil part surrounding one region of the magnetic core and generating a magnetic flux depending on a flow of current, wherein the magnetic core includes a first magnetic region formed of a first magnetic material and a second magnetic region formed of a second magnetic material different from the first magnetic material.

The second magnetic region may include a plurality of magnetic components and a non-magnetic material surrounding the plurality of magnetic components.

The plurality of magnetic components may be arranged in a preset interval unit.

The plurality of magnetic components may be arranged as a plurality of layers in the non-magnetic material.

The plurality of magnetic components and the non-magnetic material may have a preset volume ratio.

The plurality of magnetic components may be arranged on only a preset region of the non-magnetic material.

The plurality of magnetic components may be at least one of magnetic strips and magnetic powders.

The second magnetic region may include a plurality of zones having different permeabilities.

The second magnetic region may have a shape in which the plurality of zones are arranged in a direction parallel with a direction in which the magnetic flux passes through the second magnetic region.

The second magnetic region may have a shape in which the plurality of zones are arranged in a direction perpendicular to a direction in which the magnetic flux passes through the second magnetic region.

The plurality of zones may be arranged in one continuous space, or arranged in a plurality of spaces separated from each other, respectively.

The plurality of zones may move to be misaligned from an area of the first magnetic region in the magnetic core.

The second magnetic region may be configured so that only some of the plurality of zones occupy the volume thereof.

The inductor may further include: a transfer device moving the plurality of zones; and a controller controlling the transfer device to move the plurality of zones depending on an amount of load connected to a secondary side of a power conversion circuit.

According to another aspect of the present disclosure, a method for manufacturing an inductor includes: providing a magnetic core having a preset shape; forming an air-gap in one region of the provided magnetic core; filling the formed air-gap with a magnetic material different from a magnetic material of the magnetic core; and winding a coil around one region of the magnetic core filled with the different magnetic material.

The different magnetic region may include a plurality of magnetic components and a non-magnetic material surrounding the plurality of magnetic components.

The plurality of magnetic components may be arranged in a preset interval unit.

The plurality of magnetic components may be arranged as a plurality of layers in the non-magnetic material.

The plurality of magnetic components and the non-magnetic material may have a preset volume ratio.

The plurality of magnetic components may be arranged on only a preset region of the non-magnetic material.

The plurality of magnetic components may be at least one of magnetic strips and magnetic powders.

In the inductors according to various exemplary embodiments of the present disclosure described above, saturation characteristics of a core may be easily designed so that the inductors have different inductances depending on a load.

BRIEF DESCRIPTION OF THE DRAWING FIGURES

The above and/or other aspects of the present invention will be more apparent by describing certain exemplary embodiments of the present invention with reference to the accompanying drawings, in which.

DETAILED DESCRIPTION OF THE EXEMPLARY EMBODIMENTS

Hereinafter, exemplary embodiments of the present disclosure will be described in more detail with reference to the accompanying drawings.

Figure 1:
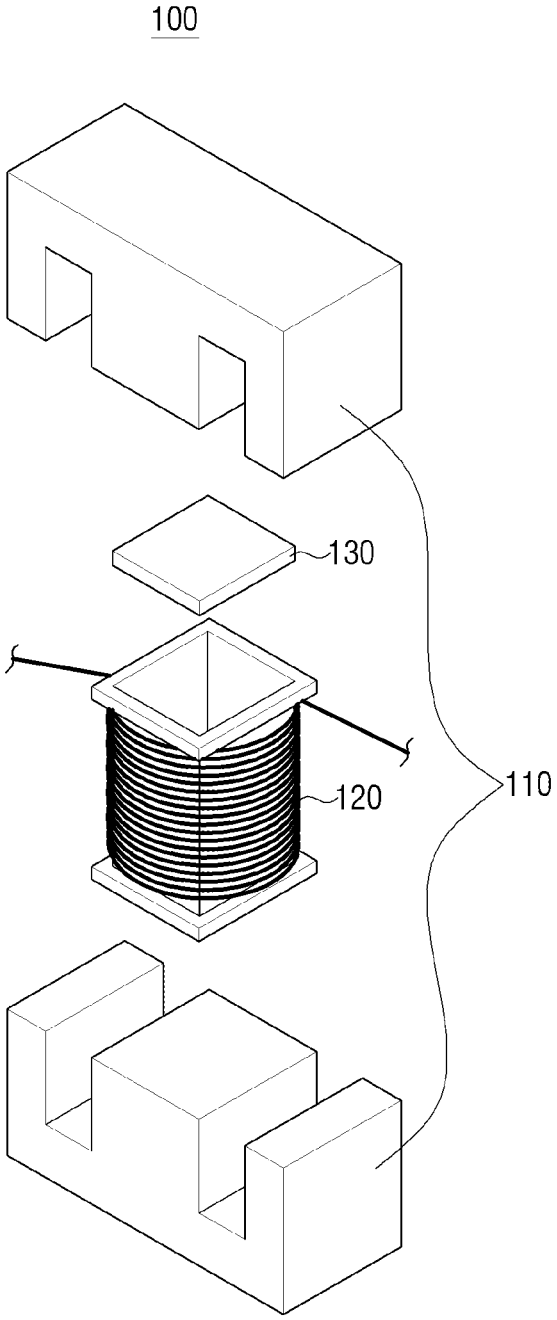
FIG. 1 is a perspective view illustrating components of an inductor according to an exemplary embodiment of the present disclosure.
Figure 2:
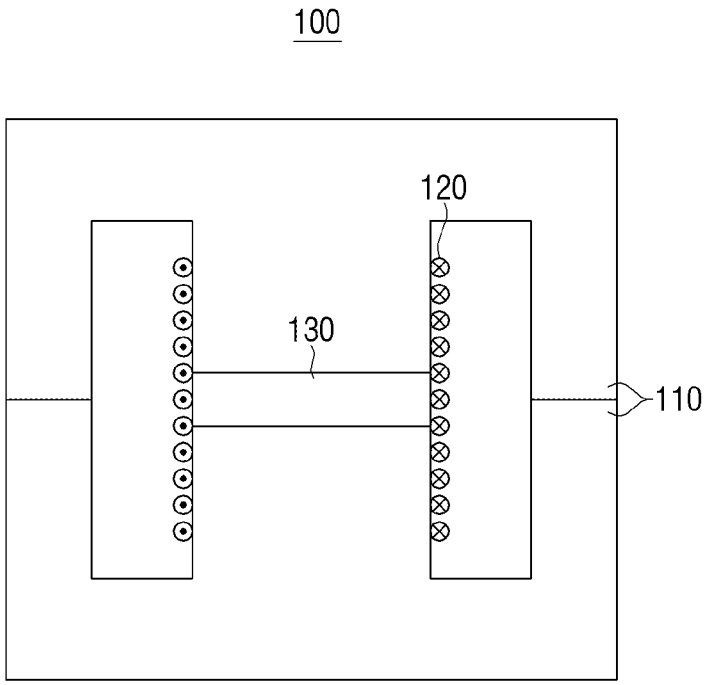
FIG. 2 is a cross-sectional view illustrating the components of the inductor according to an exemplary embodiment of the present disclosure.

FIGS. 1 and 2 are, respectively, a perspective view illustrating components of an inductor according to an exemplary embodiment of the present disclosure and an assembled cross-sectional view of the respective components.

Referring to FIG. 1, the inductor 100 according to the exemplary embodiment of the present disclosure includes magnetic cores 110 and 130 and a coil part 120.

The magnetic cores 110 and 130 have preset shapes. In detail, the magnetic cores 110 and 130 may have closed loop shapes. Therefore, energy of a magnetic field generated by a current flowing in the coil part 120 may be stored in the magnetic cores 110 and 130. In other words, a magnetic flux passing through the magnetic cores 110 and 130 may flow along paths of closed loops of the magnetic cores 110 and 130.

A magnetic flux having a direction and a magnitude is generated by a current flowing in a coil part 120 to be described below. The magnetic flux is generated along the paths of the closed loops of the magnetic cores 110 and 130. The magnetic cores 110 and 130 mean media present on paths through which the magnetic flux passes. That is, the magnetic cores 110 and 130 store energy of a magnetic field generated by a current flowing in an electric wire therein. In addition, a level (an inductance) of the current flow inhibited by the inductor 100 is determined depending on distinct permeabilities of the magnetic cores 110 and 130, respectively.

In addition, the magnetic cores 110 and 130 consist of a first magnetic region 110 formed of a first magnetic material and a second magnetic region 130 formed of a second magnetic material. The first magnetic material and the second magnetic material are different materials. In detail, the first magnetic region 110 may be a pair of EE-shaped cores including a central pillar portions and left and right pillar portions. The coil part 120 may surround the central pillar portions of the magnetic core. In addition, the magnetic flux generated by the current may pass through the left and right pillar portions, which are external paths.

Figure 14:
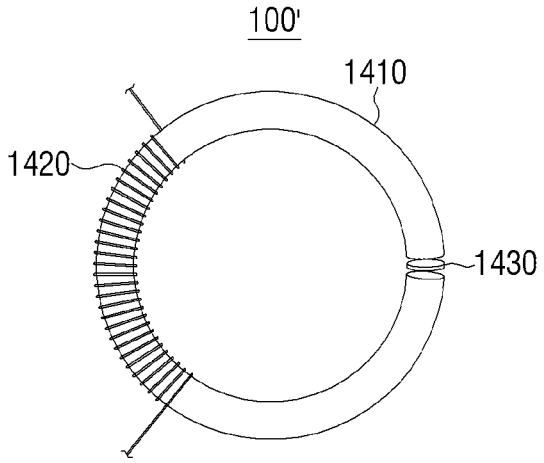
FIG. 14 is a view illustrating a structure of an inductor according to another exemplary embodiment of the present disclosure.
Figure 15:
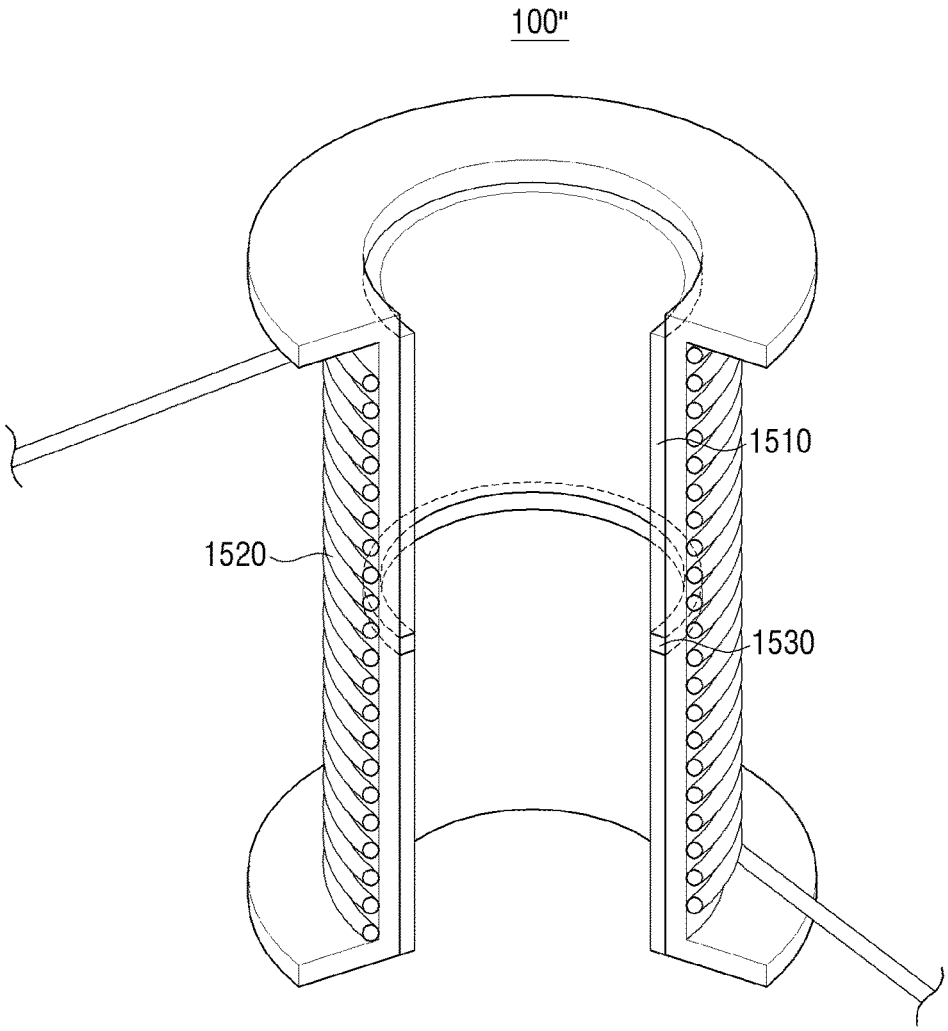
FIG. 15 is a view illustrating a structure of an inductor according to another exemplary embodiment of the present disclosure.

The first magnetic region 110 according to an exemplary embodiment may determine an entire size or shape of the inductor. Although the EE-shaped cores have been illustrated in FIG. 1, the first magnetic region 110 is not limited thereto, but may be various general cores having an air-gap portion, such as EI/EF/EER/EFD/ER/EPC/UI/CI/EP/RM cores, a toroidal core, a pot core, and the like. In addition, it is obvious to those skilled in the art that the first magnetic region 110 may be implemented in various exemplary embodiments on the basis of a commercial core having another shape as illustrated in FIG. 14 or FIG. 15.

Further, the first magnetic region 110 is a ferrite core used in a general inductor. The first magnetic material of the first magnetic region may be alpha iron or a material in which at least one of manganese oxide (MnO) and zinc oxide (ZnO) is mixed with iron oxide.

The coil part 120 surrounds a portion of the magnetic cores 110 and 130, and generates the magnetic flux depending on the flow of the current therein. In detail, the coil part 120 may be formed of a conductive conductor such as enamel copper, and may pass the current therethrough. In addition, the coil part 120 may include a cylindrical or rectangular pillar-shaped frame around which a conducting wire is wound more than one turn and the magnetic cores 110 and 130 may be inserted into the cylindrical or rectangular pillar-shaped frame.

When the current flows in the coil part 120, a magnetic field having two polarities is generated depending on the current and a direction in which the conducting wire is wound, and energy by the current is temporarily stored in a magnetic field form. The generated magnetic flux passes through bodies of the magnetic cores of which a portion is surrounded by the coil part. In addition, inductance characteristics of the inductor are determined depending on properties of the media (the magnetic cores) through which the magnetic flux passes.

The first magnetic region 110 of the magnetic cores is formed of the first magnetic material. In addition, the second magnetic region 130 of the magnetic cores is formed of the second magnetic material different from the first magnetic material. In detail, the second magnetic region 130 may include a plurality of magnetic components and a non-magnetic material surrounding the plurality of magnetic components.

The plurality of magnetic components constituting the second magnetic region 130 may be formed of a ferromagnetic material magnetized at a very large level by the magnetic field. That is, the plurality of magnetic components may be formed of a high-permeability ferromagnetic material having a magnetic susceptibility ($\chi_m$) of a positive number larger than 1. For example, the ferromagnetic material may include nickel, cobalt, iron, and alloys thereof such as mu-metal.

An entire inductance and saturation characteristics of the inductor 100 can be adjusted using magnetic saturation characteristics of the second magnetic region different from magnetic saturation characteristics of the first magnetic region.

The non-magnetic material constituting the second magnetic region 130 is a material that is not substantially affected by the magnetic field, and may be molded to surround and include the plurality of magnetic components therein. In addition, the non-magnetic material may contact the first magnetic region 110 of the magnetic cores to allow the plurality of magnetic components of the second magnetic region to be put at fixed positions. Further, the non-magnetic material may be a material having durability and heat resistance enough to endure heat generation, impact, and weight of the inductor. For example, the non-magnetic material of the second magnetic region 130 may be plastic such as polypropylene. In addition, the second magnetic region 130 may be manufactured through a plastic molding technology.

The plurality of magnetic components of the second magnetic region 130 may be arranged in a preset interval unit. In addition, the plurality of magnetic components may be arranged as a plurality of layers in the non-magnetic material. A detailed description for an arrangement of the magnetic components of the second magnetic region 130 will be provided below with reference to FIGS. 4 and 5.

The plurality of magnetic components and the non-magnetic material of the second magnetic region 130 may have a preset volume ratio. In addition, the plurality of magnetic components of the second magnetic region 130 may be arranged on only a preset region of the non-magnetic material. A detailed description for a mixing ratio and a volume ratio of the magnetic components of the second magnetic region 130 will be provided below with reference to FIGS. 6 and 7.

The plurality of magnetic components of the second magnetic region 130 may be at least one of magnetic strips and magnetic powders. Two exemplary embodiments implementing the plurality of magnetic components will be described in detail with reference to FIGS. 4 to 22.

A first exemplary embodiment in which the plurality of magnetic components is implemented by the magnetic strips is called a strip type. In addition, a second magnetic region 130 of a first exemplary embodiment in which the magnetic strips are inserted into the non-magnetic material is called a strip core. Further, a form in which the strips of the strip core are arranged at same intervals is called a strip array. Meanwhile, a second exemplary embodiment in which the plurality of magnetic components is implemented by the magnetic powders is called a powder type. In addition, a second magnetic region 130 of a magnetic core of a second exemplary embodiment in which the magnetic powders are mixed with the non-magnetic material is called a powder core.

As described above, the inductor 100 according to the exemplary embodiment of the present disclosure includes the first magnetic region formed of the first magnetic material and the second magnetic region having magnetic saturation characteristics different from those of the first magnetic region and formed of the second magnetic material. The inductor 100 according to the exemplary embodiment of the present disclosure may have characteristics that an inductance thereof is continuously varied in a driving range of an inductor current. In addition, the inductor 100 according to the exemplary embodiment of the present disclosure has a simple structure, such that parameter values that adjust magnetic saturation characteristics can be easily changed.

FIG. 2 is a cross-sectional view illustrating the components of the inductor according to an exemplary embodiment of the present disclosure.

Referring to FIG. 2, three pillars of the pair of EE-shaped cores of the first magnetic region 100 of FIG. 1 face and contact each other, and the second magnetic region 130 is provided between central pillars. In addition, the coil part 120 is wound around a central pillar region including the first magnetic region 110 and the second magnetic region 130. Although the conducting wire of the coil part 120 is exaggerated in FIG. 2, a thin and long conducting wire may be wound around the central pillar region in a physically allowable range.

Figure 3:
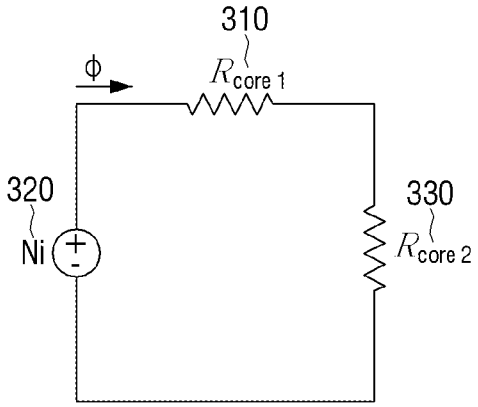
FIG. 3 is an equivalent magnetic circuit diagram of the inductor according to the exemplary embodiment of the present disclosure.

FIG. 3 is an equivalent magnetic circuit diagram of the inductor according to the exemplary embodiment of the present disclosure.

Referring to FIG. 3, the inductor 100 according to the exemplary embodiment of the present disclosure may be represented by an equivalent magnetic circuit including a magnetic-motive force 320 that is in proportion to a turn N and a current i of the coil part 120 and a magnetic reluctance $R_{core1}$ 310 of the first magnetic region and a reluctance $R_{core2}$ 330 of the second magnetic region through which a magnetic flux φ passes.

Figure 4A:
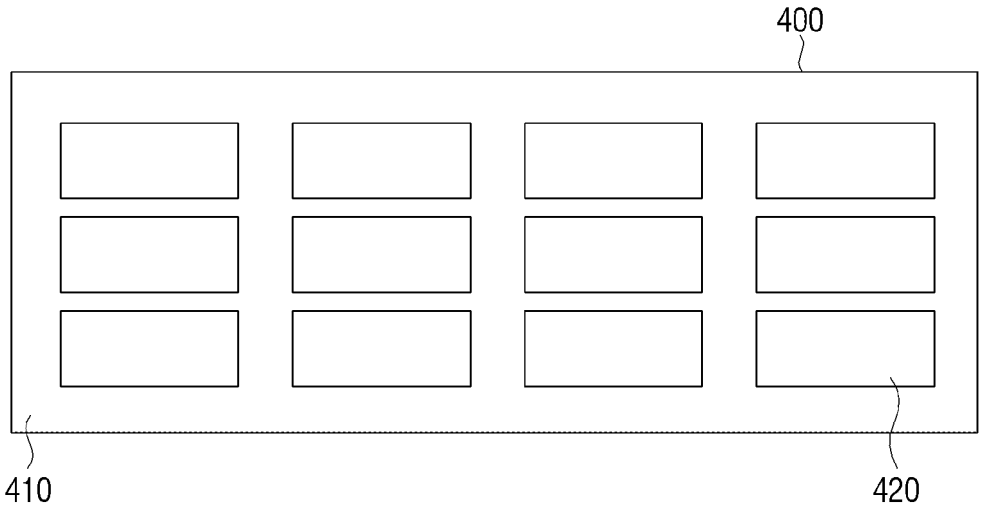
FIGS. 4A and 4B are cross-sectional views illustrating components of a second magnetic region according to a first exemplary embodiment of the present disclosure.
Figure 4B:
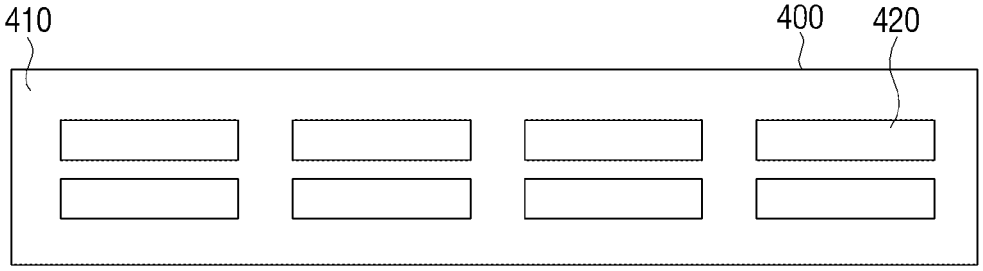

FIGS. 4A and 4B are plan and side cross-sectional views illustrating components of a second magnetic region according to a first exemplary embodiment of the present disclosure.

Referring to FIGS. 4A and 4B, the second magnetic region 400 includes a plurality of magnetic components 420 arranged in a preset interval unit in a non-magnetic material 410. In detail, as illustrated in the plan cross-sectional view (FIG. 4A) of the second magnetic region 400, the second magnetic region 400 may be configured so that strip-type magnetic components 420 are arranged at predetermined intervals in the non-magnetic material 410. In addition, as illustrated in the side cross-sectional view (FIG. 4B) of the second magnetic region 400, the second magnetic region 400 may be configured so that strip-type magnetic components 420 are arranged as a plurality of layers in parallel with each other in the non-magnetic material 410. The number of magnetic strips 420 of the second magnetic region 400 is not limited the number illustrated in FIGS. 4A and 4B, and the magnetic strips 420 may be arranged as a single layer or plural layers.

Figure 5:
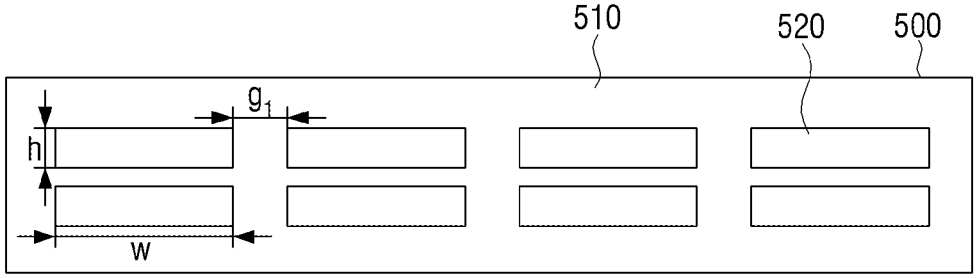
FIG. 5 is a view illustrating parameters for components of a second magnetic region according to a first exemplary embodiment of the present disclosure.

FIG. 5 is a side cross-sectional view illustrating parameters for components of a second magnetic region according to a first exemplary embodiment of the present disclosure.

Referring to FIG. 5, a side cross-sectional view of the second magnetic region 500 illustrates that magnetic strips 520 are arranged as a plurality of layers in a non-magnetic material 510. In addition, the magnetic strips 520 of upper and lower layers are arranged in parallel with each other. In detail, parameters for the magnetic strips 520 that can adjust magnetic saturation characteristics of the second magnetic region 500 include a height h and a width w of the magnetic strips 520 and a distance $g_1$ between the magnetic strips 520 in strip arrays on a plane.

As described above, magnetic saturation characteristics of the second magnetic region 500 according to a first exemplary embodiment can be adjusted by adjusting the number, sizes, and arrangement intervals of magnetic strips 520. Therefore, an inductor having magnetic saturation characteristics satisfying desired design conditions can be manufactured by adjusting the parameters described above.

Figure 6:
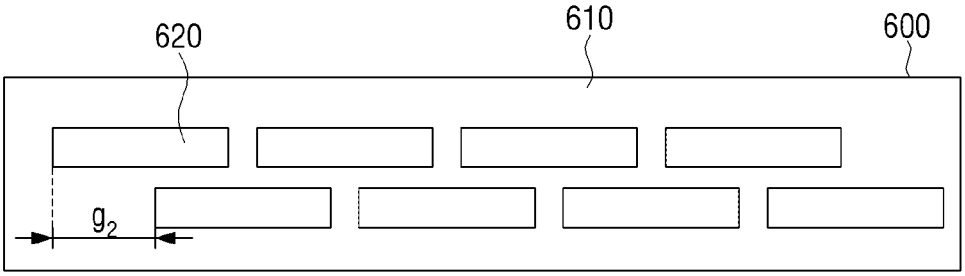
FIG. 6 is a view illustrating parameters for components of a second magnetic region according to a first exemplary embodiment of the present disclosure.

FIG. 6 is a side cross-sectional view illustrating parameters for components of a second magnetic region according to a first exemplary embodiment of the present disclosure.

Referring to FIG. 6, a side cross-sectional view of the second magnetic region 600 illustrates that magnetic strips 620 of the second magnetic region 600 are arranged as a plurality of layers in a non-magnetic material 610. In addition, the magnetic strips 620 of strip arrays of upper and lower layers are arranged to be spaced apart from each other by $g_2$ in a horizontal axis or vertical axis direction. In detail, parameters for the magnetic strips 620 that may adjust magnetic saturation characteristics of the second magnetic region 600 include a distance $g_2$ by which the magnetic strips of the upper and lower layers are spaced apart from each other.

As described above, magnetic saturation characteristics of the second magnetic region 600 according to a first exemplary embodiment can be adjusted by adjusting the number, sizes, and arrangement intervals of magnetic strips 620. Therefore, an inductor having magnetic saturation characteristics satisfying desired design conditions can be manufactured by adjusting the parameters described above.

Figure 7:
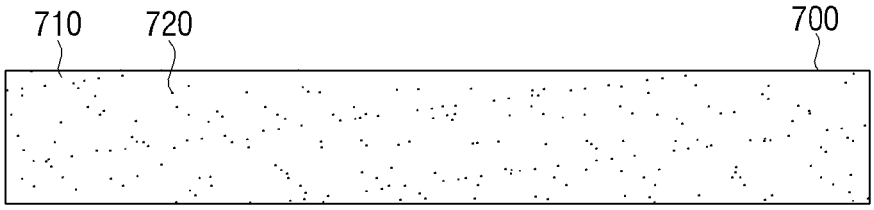
FIG. 7 is a cross-sectional view illustrating components of a second magnetic region according to a second exemplary embodiment of the present disclosure.

FIG. 7 is a cross-sectional view illustrating components of a second magnetic region according to a second exemplary embodiment of the present disclosure.

Referring to FIG. 7, a plurality of magnetic components of the second magnetic region 700 is formed of magnetic powders 720. In addition, the magnetic powders 720 are randomly distributed in a non-magnetic material 710. In detail, a second magnetic region may be formed of a mixture of the magnetic powders and the non-magnetic material 710 mixed with each other in a predetermined ratio. In addition, the magnetic powders may be randomly distributed in the non-magnetic material 710. Meanwhile, a parameter for the magnetic powders 720 that may adjust magnetic saturation characteristics of the second magnetic region 700 can be a mass ratio, a volume ratio, or a mixing ratio of the non-magnetic material 710 to the magnetic components 720. In addition, a parameter for the magnetic powder 720 is a relative permeability increased in proportion to a content of magnetic powder 720 present in the second magnetic region 700.

Figure 8:
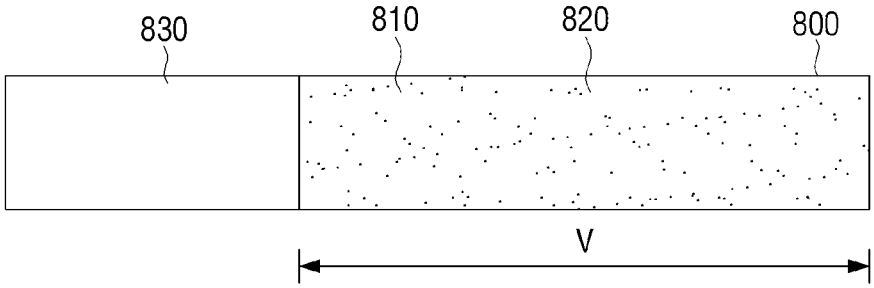
FIG. 8 is a view illustrating other components of the second magnetic region according to a second exemplary embodiment of the present disclosure.

FIG. 8 is a cross-sectional view illustrating another configuration of the second magnetic region according to a second exemplary embodiment of the present disclosure.

Referring to FIG. 8, some of the second magnetic region is formed of only a non-magnetic material 830, and powder-type magnetic components 820 are randomly distributed in a non-magnetic material 810 in the other region of the second magnetic region. In detail, magnetic powders that have an influence on a path through which a magnetic flux passes are present only in some of the region, such that magnetic saturation characteristics of the inductor can be changed. In other words, a parameter for the magnetic powder 820 that may adjust magnetic saturation characteristics of the second magnetic region 800 includes a volume ratio v between the regions formed of only the non-magnetic material 830 and the power type region in which the powder-type magnetic components 820 are mixed with the non-magnetic material 810.

As described above, magnetic saturation characteristics of the second magnetic region according to a second exemplary embodiment can be adjusted by adjusting an amount of magnetic powders and a size of the region in which the powder-type magnetic components 820 are mixed with the non-magnetic material. Therefore, an inductor having magnetic saturation characteristics satisfying desired design conditions can be manufactured by adjusting the parameters described above.

Figure 9:
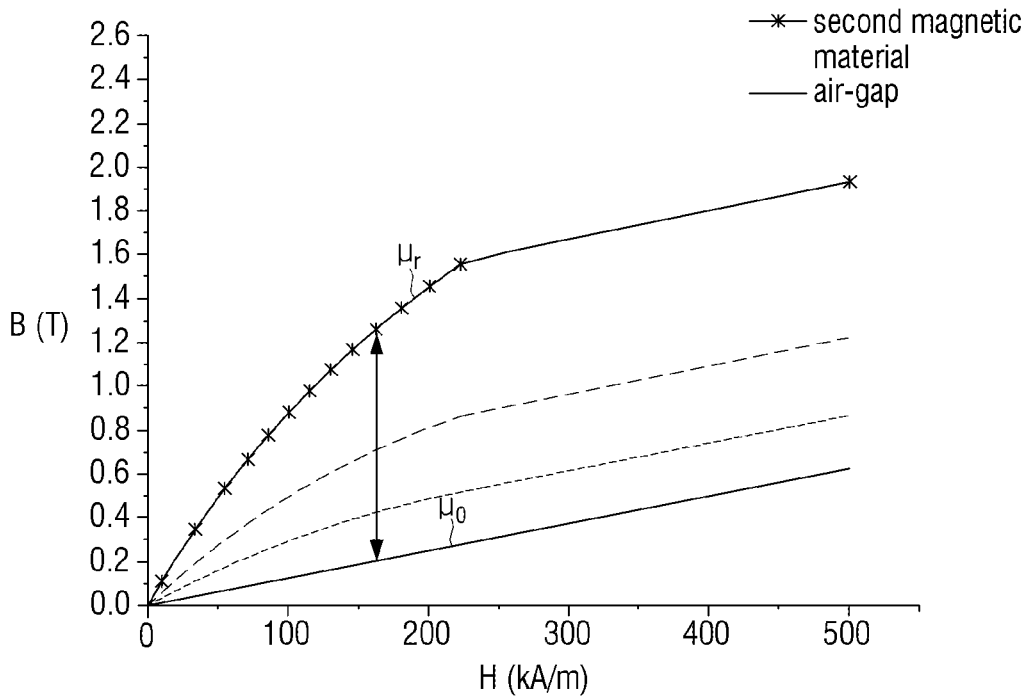
FIG. 9 is a view illustrating B-H curves of the second magnetic region according to an exemplary embodiment of the present disclosure.

FIG. 9 is a view illustrating B-H curves of the second magnetic region having various components according to exemplary embodiments of the present disclosure.

Referring to FIG. 9, a B-H curve in the case that the second magnetic region is formed of only the magnetic material and B-H curves in cases than the second magnetic region has a plurality of composition ratios including the non-magnetic material according to an exemplary embodiment of the present disclosure are illustrated. In detail, a gradient in the B-H curve means a relative permeability. In addition, a general inductor having an air-gap has a vacuum permeability (μ0), such that the gradient always has a constant value. To the contrary, in the inductor having the second magnetic region according to the present disclosure, an magnetic field intensity H is changed depending on a composition ratio of the second magnetic region. In addition, the inductor having the second magnetic region according to the present disclosure has a non-linear gradient depending on the change in the magnetic field intensity H, and the flux variation of the inductor having the second magnetic region is larger than that of the air-gap inductor.

In according to the Ampere's circuital law, the intensity H of the magnetic field is in proportion to a current and winding turn, and an inductance is in proportion to permeability. Therefore, in the inductor according to the present disclosure, non-linear variable characteristics of an inductance depending on a current variation can be controlled on the basis of magnetic saturation characteristics of the second magnetic region.

Hereinabove, the structures of the inductor and the second magnetic region according to an exemplary embodiment of the present disclosure have been described with reference to the accompanying drawings. FIGS. 10 to 13 are views for describing change characteristics of an inductance for an inductor current when parameters of the second magnetic region are adjusted. The first magnetic region of the inductor used in experiments of FIGS. 10 to 13 is an EE-shaped ferrite core. In addition, a structure of the EE-shaped ferrite core according to an industrial standard indicating method is A:70.50, B:33.20, C:32.00, D:48.00, E:22.00, and F:21.90.

Figure 10:
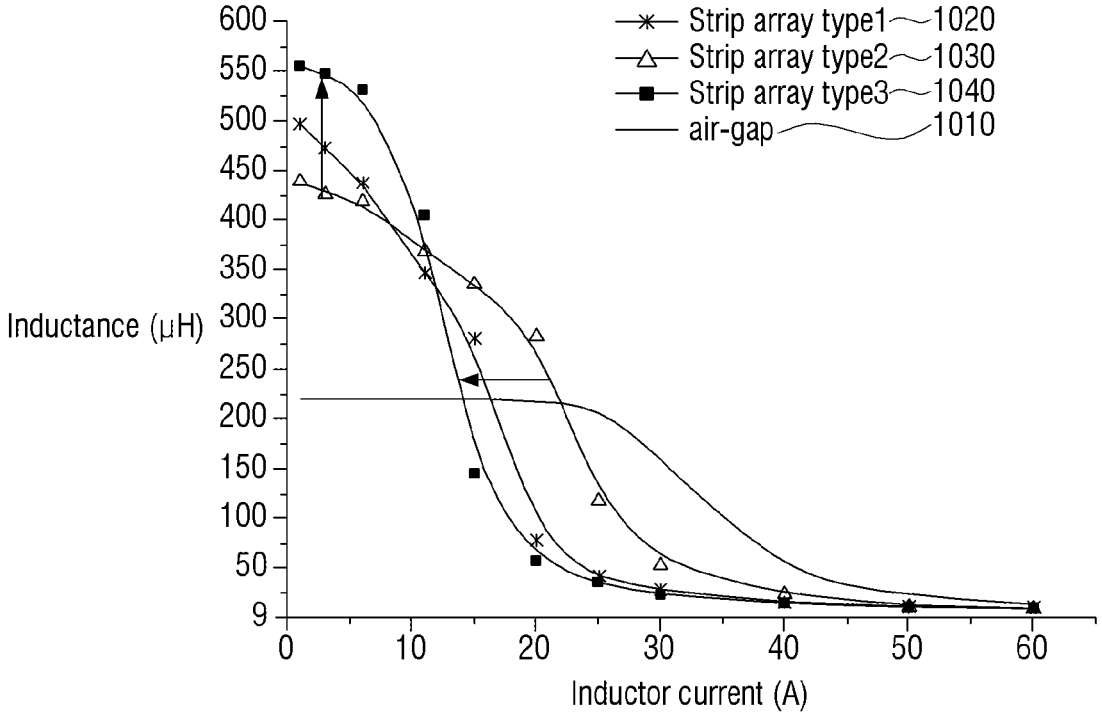
FIG. 10 is a view illustrating a change in magnetic saturation characteristics when parameters of the second magnetic region according to a first exemplary embodiment of the present disclosure are adjusted.

FIG. 10 is a view illustrating inductance change characteristics when parameters of the second magnetic region according to a first exemplary embodiment of the present disclosure are adjusted.

Referring to FIG. 10, inductance (L) change curves 1010, 1020, 1030, and 1040 of four inductors depending on an inductor current $i_L$ are illustrated. In detail, a horizontal axis indicates a current flowing in the coil part 120 and is represented in an ampere unit. A vertical axis indicates an inductance value and is represented in a micro Henry unit.

A first inductance change curve 1010 relates to an inductor in which the second magnetic region is provided as an air-gap (i.e. an empty space). In addition, second, third, and fourth inductance change curves 1020, 1030, and 1040 relate to inductors in which the second magnetic regions include the plurality of magnetic strips 520 and the non-magnetic material 510 surrounding the plurality of magnetic strips 520 according to a first exemplary embodiment of the present disclosure. Meanwhile, parameters of the second magnetic regions of the inductors relating to the second, third, and fourth inductance change curves 1020, 1030, and 1040 include a height h and a width w of the magnetic strips 520, a distance $g_1$ between the magnetic strips, and a distance $g_2$ by which the magnetic strips of two layers are spaced apart from each other in one axis direction. In addition, the second, third, and fourth inductance change curves 1020, 1030, and 1040 relate to three-type inductors in which at least one of the parameters described above is adjusted. The parameters of the three inductors 100 are represented in Table 1.

TABLE 1

| | Strip Array (mm) | | |
|---|---|---|---|
| | Type 1 | Type 2 | Type 3 |
| h | 0.6 | 0.6 | 1.4 |
| w | 4 | 4 | 1 |
| $g_1$ | 1.2 | 0.6 | 1 |
| $g_2$ | 0 | 2.3 | 0 |

Referring to FIG. 10, an air-gap inductor, which is a control group, has an almost constant inductance value up to an inductor current range of 20 A, and has an inductance decreased in a smooth gradient due to magnetic saturation at an inductor current larger than 20 A. However, the inductors 100 according to an exemplary embodiment of the present disclosure have inductances larger than that of the air-gap inductor at a low inductor current. In addition, the inductors 100 according to an exemplary embodiment of the present disclosure are rapidly saturated even at a low current, such that inductances of the inductors 100 are decreased in a gradient larger than that of the air-gap inductor. Further, when the parameters such as h, w, $g_1$, and $g_2$ are adjusted, inductance change characteristics of the inductors 100 having the second magnetic region according to a first exemplary embodiment of the present disclosure are different with other.

Figure 11:
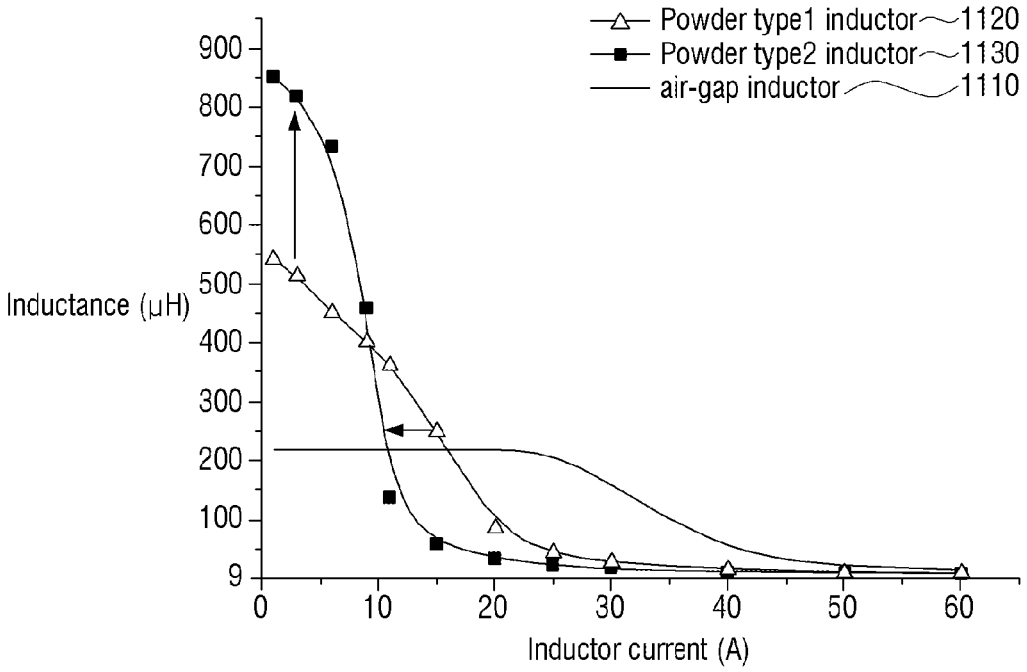
FIG. 11 is a view illustrating a change in magnetic saturation characteristics when a composition ratio of the second magnetic region according to a second exemplary embodiment of the present disclosure is adjusted.

FIG. 11 is a view illustrating a inductance change characteristics when a composition ratio of the second magnetic region according to a second exemplary embodiment of the present disclosure is adjusted.

Referring to FIG. 11, inductance (L) change curves 1110, 1120, and 1130 of inductors depending on an inductor current $i_L$ are illustrated. In detail, a horizontal axis indicates a current flowing in the coil part 120 and is represented in an ampere unit. A vertical axis indicates an inductance value and is represented in a micro Henry unit.

A first inductance change curve 1110 illustrated in a graph of FIG. 11 relates to an inductor in which the second magnetic region is provided as an air-gap (i.e. an empty space). In addition, second and third inductance change curves 1120 and 1130 relate to inductors 100 in which the second magnetic regions include the magnetic powders 720 and the non-magnetic material 710 surrounding the magnetic powders 720 according to a second exemplary embodiment of the present disclosure. That is, the second and third inductance change curves 1120 and 1130 relate to two-type inductors where mixing ratios of the magnetic powders 720 in the second magnetic regions are different from each other. The two inductors 100 can be divided as follows depending on the mixing ratios of the magnetic powders on the basis of a relative permeability ($\mu_r$) of the second magnetic region.

TABLE 2

| | Powder Core | |
|---|---|---|
| | Type 1 | Type 2 |
| Initial Value $\mu_r$ | 3 | 5 |

Referring to graphs of FIG. 11, the inductance change curves 1120 and 1130 of the inductors 100 according to a second exemplary embodiment of the present disclosure show a high inductance and fast saturation characteristics at a low inductor current as compared with the inductance change curve of an air-gap inductor. In addition, the inductance change curves 1120 and 1130 of the inductors 100 according to a second exemplary embodiment of the present disclosure show a higher inductance and faster saturation characteristics at a low current as a ratio of the magnetic powders in the second magnetic region becomes higher.

Figure 12:
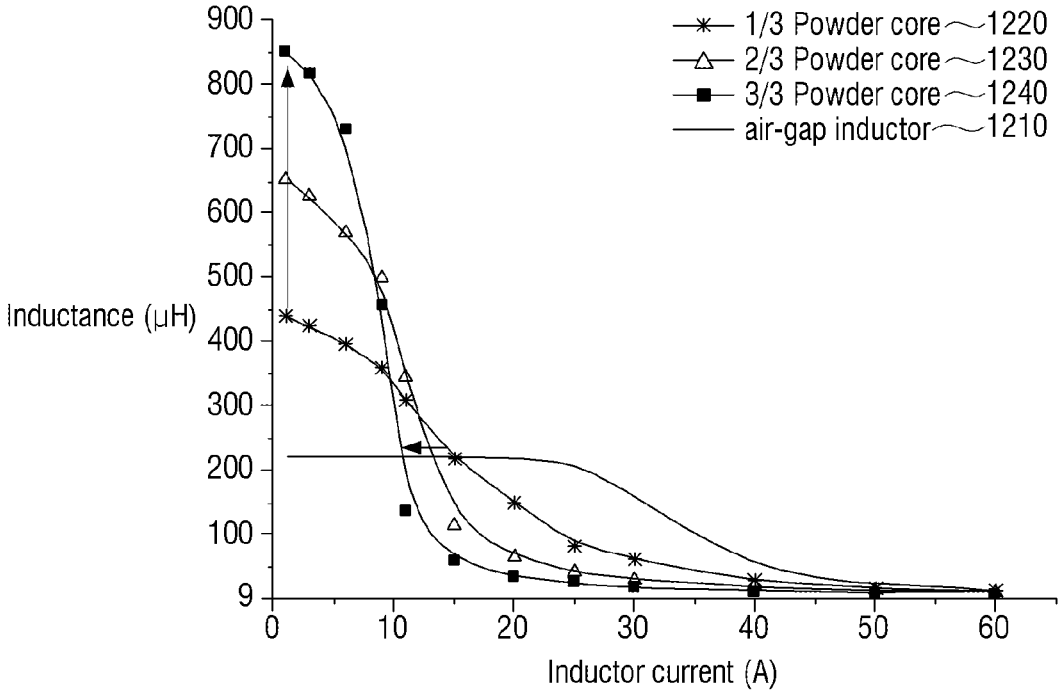
FIG. 12 is a view illustrating a change in magnetic saturation characteristics when a volume ratio of the second magnetic region according to a second exemplary embodiment of the present disclosure is adjusted.

FIG. 12 is a view illustrating a inductance change characteristics when a volume ratio of the second magnetic region according to a second exemplary embodiment of the present disclosure is adjusted.

Referring to FIG. 12, inductance change curves 1210, 1220, 1230, and 1240 depending on an inductor current $i_L$ are illustrated. In detail, a horizontal axis indicates a current flowing in the coil part 120 and is represented in an ampere unit. A vertical axis indicates an inductance value and is represented in a micro Henry unit.

A first inductance change curve 1210 illustrated in FIG. 12 relates to an inductor in which the second magnetic region is provided as an air-gap (i.e. an empty space). In addition, second, third, and fourth inductance change curves 1220, 1230, and 1240 relate to inductors 100 in which the second magnetic regions include the magnetic powders 820 and the non-magnetic material 810 surrounding the magnetic powders 820 according to a second exemplary embodiment of the present disclosure. The second magnetic material is a material in which the magnetic powders 820 and the non-magnetic material 810 are mixed with each other. That is, the second, third, and fourth inductance change curves 1220, 1230, and 1240 relate to an inductor 100 in which the entire volume of the second magnetic region 800 is occupied by the second magnetic material, an inductor 100 in which ⅔ of the entire volume of the second magnetic region 800 is occupied by the second magnetic material, and an inductor 100 in which ⅓ of the entire volume of the second magnetic region 800 is occupied by the second magnetic material.

As illustrated in FIG. 12, the inductors 100 including the second magnetic regions according to a second exemplary embodiment of the present disclosure show a higher inductance and faster saturation characteristics at a low current as a volume ratio occupied by the second magnetic material becomes higher.

Figure 13:
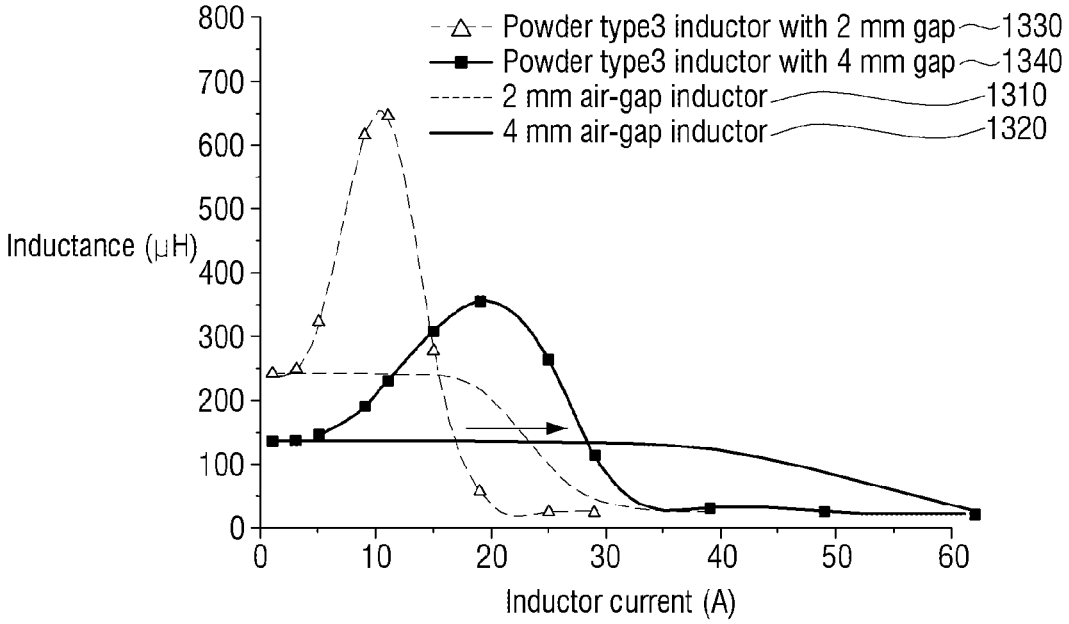
FIG. 13 is a view illustrating a change in magnetic saturation characteristics when a magnetic material of the second magnetic region according to a second exemplary embodiment of the present disclosure is adjusted.

Referring to FIG. 13, inductance (L) change curves 1310, 1320, 1330, and 1340 depending on an inductor current $i_L$ are illustrated. In detail, a horizontal axis indicates a current flowing in the coil part 120 and is represented in an ampere unit. A vertical axis indicates an inductance value and is represented in a micro Henry unit.

A first inductance change curve 1310 and a second inductance change curve 1320 illustrated in graphs of FIG. 13 relate to inductors in which the second magnetic regions having heights of 2 mm and 4 mm are provided as air-gaps (i.e. empty spaces). In addition, third and fourth inductance change curves 1330 and 1340 for inductors according to a second exemplary embodiment of the present disclosure relate to inductors 100 in which the second magnetic regions include the magnetic powders 820 made of a rare earth metal and the non-magnetic material 810 surrounding the magnetic powders 820. In addition, the third and fourth inductance change curves 1330 and 1340 relate to inductors 100 in which heights of the second magnetic regions 800 are 2 mm and 4 mm, respectively.

As illustrated in FIG. 13, the inductors 100 having the second magnetic regions formed of the rare earth metal powders according to a second exemplary embodiment of the present disclosure show different characteristics from those of an existing inductor having a second magnetic region formed of ferromagnetic metal powders. That is, the inductors 100 having the second magnetic regions formed of the rare earth metal powders show a high inductance in a high current region and show slower saturation characteristics as the height of the second magnetic region 800 becomes higher.

As described above, inductance characteristics of the inductor 100 including the second magnetic region according to a first or second exemplary embodiment of the present disclosure can be adjusted using several parameters such as the composition ratio, the volume ratio of the second magnetic material, the magnetic material change, the height of the second magnetic region, and the like. Hereby, an inductance value and a driving range of an inductor current can be easily adjusted according to a design goal.

FIG. 14 is a view illustrating a structure of an inductor according to another exemplary embodiment of the present disclosure.

Referring to FIG. 14, the inductor 100' includes O-shaped or toroidal magnetic cores 1410 and 1430 and a coil part 1420. In detail, a commercial O-shaped core formed of a first magnetic material is a first magnetic region. In addition, a second magnetic region formed of a second magnetic material is inserted into a portion of the first magnetic region, such that magnetic cores may be configured. In addition, the coil part may be formed of a conducting wire surrounding a portion of the magnetic cores. The coil part is not limited to that illustrated in FIG. 14, and more coils may be wound over wider region of the magnetic cores.

In the inductor 100' according to another exemplary embodiment of the present disclosure as described above, the second magnetic region of the magnetic cores is exposed to the outside. Therefore, the second magnetic material satisfying desired inductance saturation characteristics is easily inserted and replaced. In addition, although not illustrated, a separate circuit is provided in the vicinity of the inductor 100', and may control the second magnetic region to move in an air-gap of the first magnetic region. Therefore, a volume ratio of the second magnetic region providing a path through which a magnetic flux flowing in the magnetic cores passes can be changed. In addition, the change in the volume ratio of the second magnetic region can change magnetic saturation characteristics of the inductor.

FIG. 15 is a view illustrating a structure of an inductor according to another exemplary embodiment of the present disclosure.

Referring to FIG. 15, the inductor 100" includes cylindrical magnetic cores 1510 and 1530 and a coil part 1520. In detail, a commercial cylindrical core is provided as a first magnetic region in the coil part 1520 in which a conducting wire is wound around a long cylinder, and a second magnetic region formed of a second magnetic material may be provided in the cylindrical core.

In the inductor 100" according to another exemplary embodiment of the present disclosure as described above, only a protion of the commercial core may include the second magnetic region formed of a heterogeneous magnetic material. Therefore, inductance saturation characteristics of the inductor 100" are easily changed, such that an inductance for an inductor current can be varied.

Figure 16:
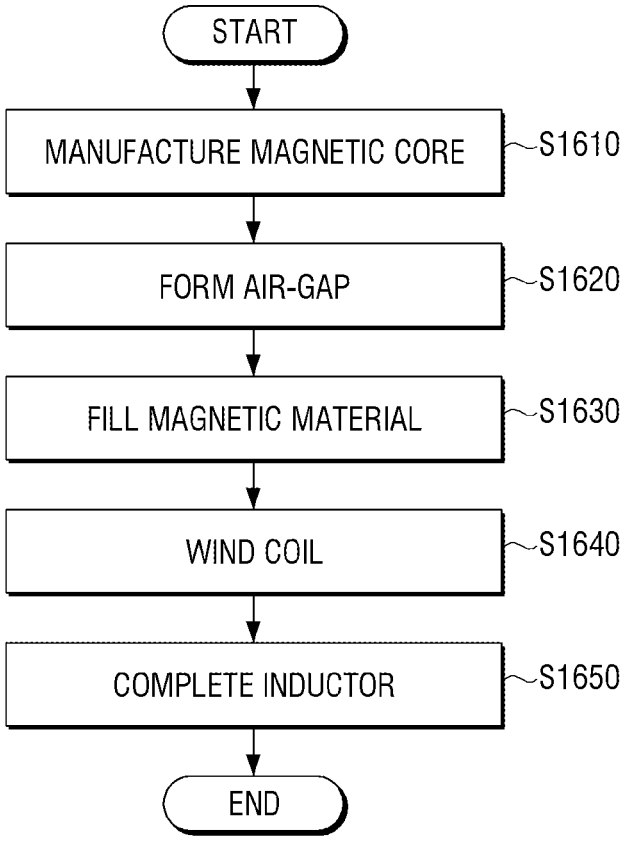
FIG. 16 is a flow chart illustrating a method for manufacturing an inductor according to another exemplary embodiment of the present disclosure.

FIG. 16 is a flow chart illustrating a method for manufacturing an inductor according to an exemplary embodiment of the present disclosure.

Referring to FIG. 16, the method for manufacturing an inductor according to the exemplary embodiment of the present disclosure includes manufacturing a magnetic core (S1610), forming an air-gap (S1620), filling a magnetic material (S1630), and winding a coil (S1640).

In the manufacturing of the magnetic core (S1610), a magnetic core having a preset shape is provided. In detail, the magnetic core may be a commercial inductor component such as an EE ferrite core. In addition, the preset shape may be a shape formed along a closed path of a magnetic flux generated when a current flows in a coil. In addition, inductance may be determined depending on permeability of the magnetic core.

In the forming of the air-gap (S1620), an air-gap is formed in one region of the magnetic core. In detail, the air-gap in which an empty space is present may be formed on a closed path through which a magnetic flux in the magnetic core passes.

In the filling of the magnetic material (S1630), the air-gap is filled with a magnetic material different from a magnetic material configuring the magnetic core. In detail, a first magnetic region is a ferrite core used in a general inductor, and a first magnetic material of the first magnetic region may be alpha iron or a material in which Mn and Zn are mixed with each other. In addition, a second magnetic material different from the first magnetic material may be a material having a different permeability from that of the first magnetic material. In addition, the magnetic material filled in the air-gap may include a plurality of magnetic components and a non-magnetic material surrounding the plurality of magnetic components. In detail, the plurality of magnetic components may be formed of a high-permeability ferromagnetic material having a magnetic susceptibility ($\chi_m$) of a positive number larger than one. For example, the magnetic material may include nickel, cobalt, iron, and alloys thereof such as mu-metal. In addition, the non-magnetic material is a material that is not substantially affected by a magnetic field. Further, the non-magnetic material may be molded to surround and include the plurality of magnetic components therein. Further, the non-magnetic material may be a material having durability and heat resistance. For example, the non-magnetic material may be plastic such as polypropylene. In addition, the different magnetic material may be manufactured through a plastic molding technology.

Meanwhile, a plurality of magnetic components of the different magnetic material may be arranged in a preset interval unit. Further, the plurality of magnetic components of the different magnetic material may be arranged as a plurality of layers in the non-magnetic material.

Meanwhile, the plurality of magnetic components and a non-magnetic material of the different magnetic material may have a preset volume ratio. In addition, the plurality of magnetic components of the different magnetic material may be arranged on only a preset region in the non-magnetic material.

Meanwhile, the plurality of magnetic components of the different magnetic material may be at least one of magnetic strips and magnetic powders.

In the winding of the coil (S1640), the air-gap of the magnetic core is filled with the different magnetic material from that of the magnetic core. In addition, the coil is wound in a portion of the magnetic core filled with the different magnetic material. In detail, the coil may be a conductive conductor such as enamel copper, and may pass the current therethrough. In addition, a magnetic flux may be generated depending on the current flowing along the coil.

The method for manufacturing an inductor according to the present disclosure as described above may be realized by an apparatus for manufacturing an inductor. In detail, the apparatus for manufacturing an inductor may be a machine for performing a control to execute each step of the method for manufacturing an inductor.

For example, the magnetic core may be manufactured in the preset shape through processes of heating, compressing, and molding ferrite (the first magnetic material) having a powder shape. Alternatively, the manufacturing of the magnetic core (S1610) may be omitted, and an existing commercial core may be used. In this case, the magnetic core may be designed in a preset shape for including an air-gap. A separate second magnetic core generating line may be included in order to form a second magnetic region in the air-gap. A second magnetic core may be manufactured through chemical and physical processes such as mixing, firing, processing, and the like, using the second magnetic material, and it may be inserted into the air-gap of the magnetic core. The coil part may be manufactured by winding a conducting wire around a portion or the entirety of the magnetic core. Alternatively, the coil part may be manufactured by winding the conducting wire around a coil bobbin surrounding an outer side of the magnetic core.

Figure 17:
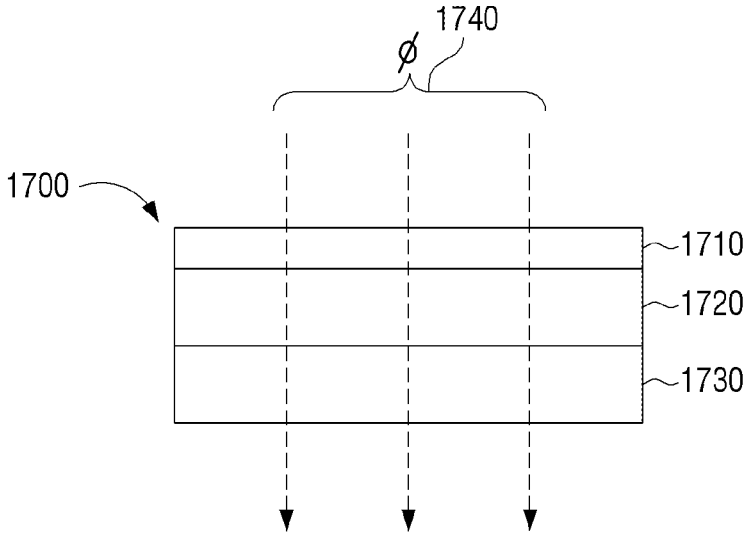
FIG. 17 is a view illustrating components of a second magnetic region according to a third exemplary embodiment of the present disclosure.

FIG. 17 is a side view illustrating components of a second magnetic region according to a third exemplary embodiment of the present disclosure.

Referring to FIG. 17, the second magnetic region 1700 may include a plurality of zones (blocks) 1710, 1720, and 1730. In detail, the second magnetic region 1700 may include a plurality of zones having different permeabilities.

Here, a block (a zone) having a specific permeability may be the strip-type or powder-type core described above. In addition, permeabilities different from each other in each block may be determined depending on the parameters described above. For example, the numbers of strips inserted into the respective blocks constituting the second magnetic region or amounts of powders contained in the respective blocks may be different from each other. Although three blocks 1710, 1720, and 1730 have been illustrated in FIG. 17, the number of blocks may be two or four or more. In addition, although sizes of the respective blocks 1710, 1720, and 1730 are different from each other in FIG. 17, sizes of the respective blocks 1710, 1720, and 1730 may be the same as each other.

The magnetic flux 1740 may occur in a direction parallel to the direction in which the plurality of zones 1710, 1720 and 1730 of the second magnetic region 1700 are stacked. In detail, the plurality of blocks 1710, 1720, and 1730 constituting the second magnetic region 1700 may be arranged to face each other in a direction of the magnetic flux 1740. Here, the plurality of blocks 1710, 1720, and 1730 may be inserted into an air-gap of the first magnetic region in a lump form in which they are stacked to contact each other. Alternatively, the plurality of blocks 1710, 1720, and 1730 may be inserted into each of a plurality of air-gaps provided in the first magnetic region.

Magnetic field energy generated by the coil part is also stored in the blocks 1710, 1720, and 1730. In addition, the blocks having the different permeabilities have different saturation characteristics. As the current of the coil part is increased, a block 1710 having a small capacity is first saturated. In addition, inductance characteristics of the inductor appear by the other blocks 1720 and 1730 that are not yet saturated.

Figure 18:
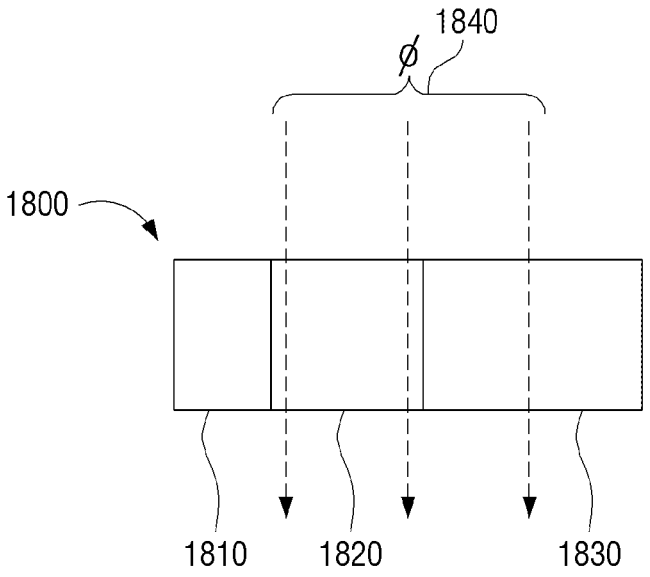
FIG. 18 is a view illustrating components of a second magnetic region according to a fourth exemplary embodiment of the present disclosure.

FIG. 18 is a side view illustrating components of a second magnetic region according to a fourth exemplary embodiment of the present disclosure.

Referring to FIG. 18, the second magnetic region 1800 may include a plurality of zones (blocks) 1810, 1820, and 1830. In detail, the second magnetic region 1800 may include a plurality of blocks 1810, 1820, and 1830 having different permeabilities.

The magnetic flux 1840 may occur in a direction perpendicular to the direction in which the plurality of zones 1810, 1820 and 1830 of the second magnetic region 1800 are stacked. In detail, the plurality of blocks 1810, 1820, and 1830 constituting the second magnetic region 1800 may be arranged in a transversal direction with each other so as to be parallel to a direction of the magnetic flux 1840. Here, a direction in which the plurality of blocks 1810, 1820, and 1830 are arranged is substantially perpendicular to the direction of the magnetic flux 1840. In addition, the plurality of blocks 1810, 1820, and 1830 may be inserted into an air-gap of the first magnetic region in a lump form in which they contact each other. Alternatively, the plurality of blocks 1810, 1820, and 1830 may be inserted into each of a plurality of air-gaps provided in the first magnetic region.

In the second magnetic region according to a fourth exemplary embodiment, a flow of the magnetic flux toward the first block saturated among the plurality of blocks may be limited, such that relatively apparent inductance change characteristics may appear.

Figure 19:
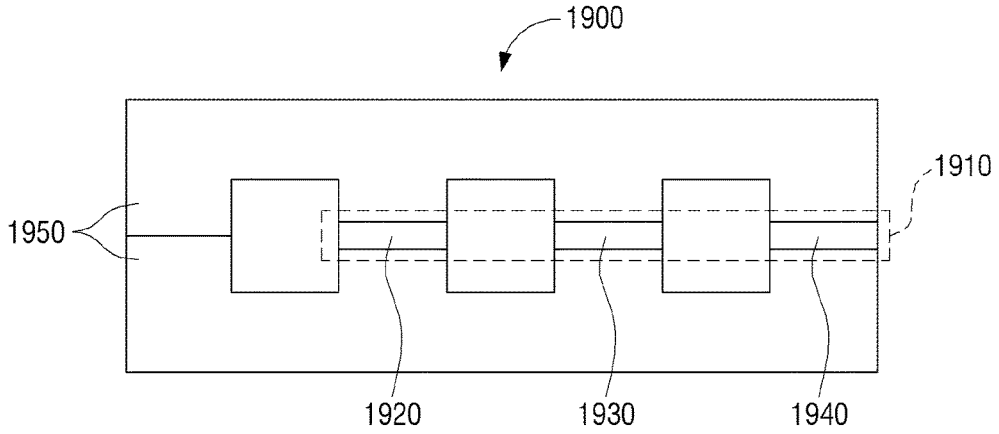
FIG. 19 is a view of a magnetic core illustrating components of a second magnetic region according to a fifth exemplary embodiment of the present disclosure.

FIG. 19 is a side view of a magnetic core for illustrating components of a second magnetic region according to a fifth exemplary embodiment of the present disclosure.

Referring to FIG. 19, the magnetic core 1900 includes a first magnetic region 1950 and a second magnetic region 1910. In addition, the second magnetic region 1910 includes a plurality of zones 1920, 1930, and 1940 having different permeabilities.

The first magnetic region 1950 includes air-gaps formed in a plurality of positions. Although the air-gaps have been formed in a horizontal direction in the first magnetic region 1950 of the magnetic core 1900 in FIG. 19, the air-gaps are not limited thereto. They may be formed in any positions of a closed loop path of a magnetic flux as long as the number of air-gaps is two or more.

The plurality of zones 1920, 1930, and 1940 of the second magnetic region 1910 may be positioned in a plurality of air-gaps. One block or a plurality of blocks may be positioned in one air-gap.

In the magnetic core 1900 as described above inductance characteristics may be designed by forming a plurality of core blocks and then inserting one block or a combination of several blocks into the air-gaps of the ferrite core.

Figure 20:
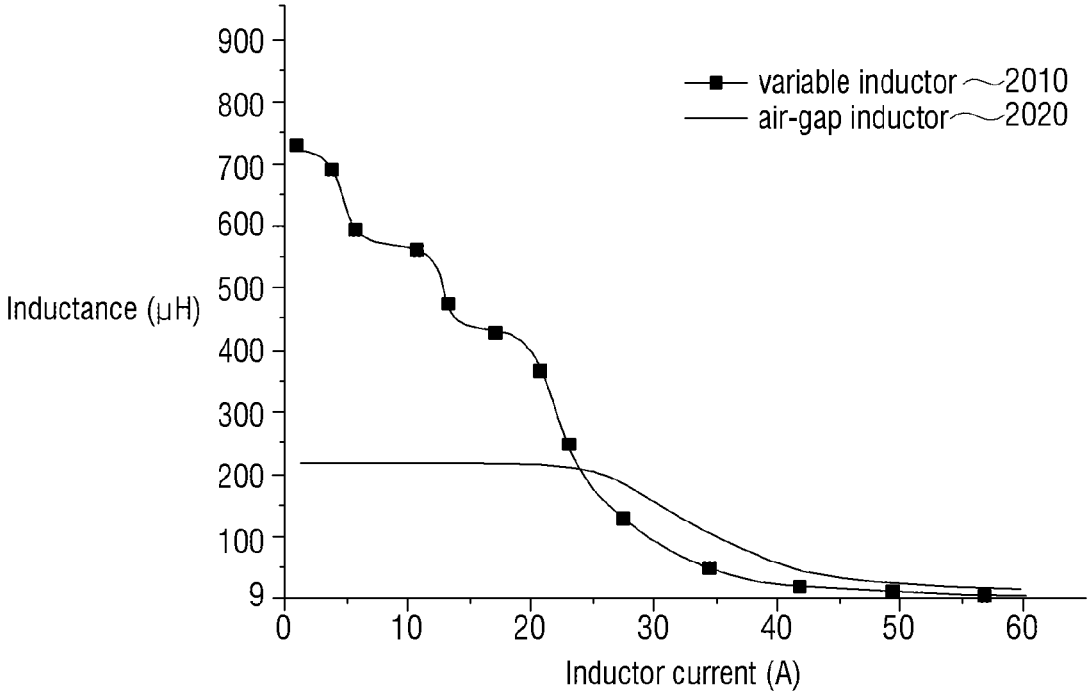
FIG. 20 is a graph for describing inductance characteristics of an inductor using the second magnetic regions of FIGS. 17 to 19.

FIG. 20 is a graph for describing inductance characteristics of an inductor using the second magnetic regions of FIGS. 17 to 19.

Referring to FIG. 20, inductance characteristics of an air-gap inductor 2020 in which only an air-gap is present in a magnetic core are illustrated compared with those of a variable inductor having the same size. An inductance of the air-gap inductor 2020 shows characteristics that it is substantially constant in a low current range and is gradually decreased and saturated in the vicinity of a current of approximately 25 A.

Meanwhile, in FIG. 20, inductance characteristics of a variable inductor 2010 including a second magnetic region with a plurality of zones (blocks) having different permeabilities are also illustrated. An inductance of the variable inductor 2010 shows stair-shaped characteristics that a change in inductances appears hardly in three current bands corresponding to the number of blocks. The plurality of blocks having different permeabilities store magnetic energy therein, respectively. As an inductor current is increased, a change in an inductance of at saturated block disappears by turns. Then, as the inductor current is continuously increased, an inductance is rapidly decreased, such that a stair-shaped graph appears.

Figure 21:
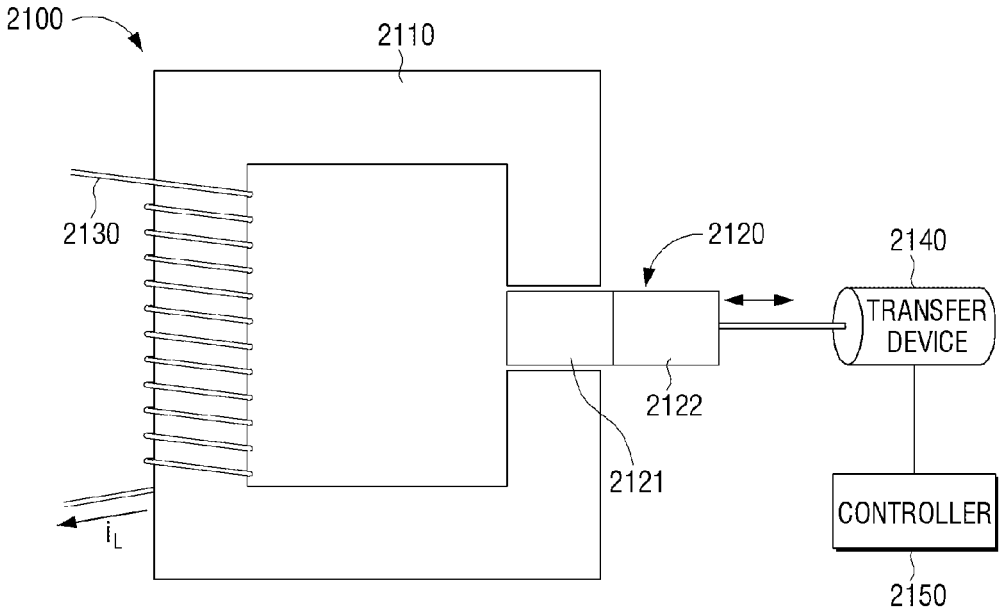
FIG. 21 is a block diagram illustrating components of an inductor according to an exemplary embodiment of the present disclosure.

FIG. 21 is a block diagram illustrating components of an inductor according to an exemplary embodiment of the present disclosure.

Referring to FIG. 21, the inductor includes a magnetic core 2100 including a first magnetic region 2110 and a second magnetic region 2120, a coil part 2130, a transfer device 2140, and a controller 2150.

The second magnetic region 2120 includes a plurality of zones 2121 and 2122 having different permeabilities. In addition, the plurality of zones 2121 and 2122 may move to be misaligned from an air-gap area of the first magnetic region 2110 in the magnetic core 2100. In other words, some of the plurality of blocks 2121 and 2122 of the second magnetic region 2120 may be positioned in an air-gap portion provided in the first magnetic region 2110. As illustrated, the second magnetic region includes the plurality of zones 2121 and 2122 arranged in a movement direction.

The transfer device 2140 moves the second magnetic region 2120. In detail, the transfer device 2140 may move a portion of the second magnetic region 2120 to be positioned in an air-gap area (a space) connected from the first magnetic region 2110.

The transfer device 2140 may include a power generation device using electric energy, such as an electric motor (a motor), and the second magnetic region 2120 may move by rotation motion of the electric motor.

The controller 2150 may sense an inductor current $i_L$. In detail, the controller 2150 may sense a magnitude of a current $i_L$ flowing in the coil part 2130. The controller 2150 may include a digital ammeter for sensing the magnitude of the current $i_L$.

The controller 2150 controls the transfer device 2140. In detail, the controller 2150 may control the transfer device 2140 to move the second magnetic region 2120. As an example, the controller 2150 may include a driver generating a control signal for controlling the electric motor of the transfer device 2140.

In the present exemplary embodiment, the inductor may be used in a power conversion circuit. Here, the controller 2150 may measure a load amount from the inductor current $i_L$. In detail, the controller 2150 may decide whether or not the load amount is less than a preset threshold value on the basis of an input voltage $v_{in}$ and an input current $i_{in}$ corresponding to initial conditions, an inductance L of the inductor corresponding to a position of the second magnetic region 2120 moved by the transfer device 2140, and the inductor current $i_L$. Alternatively, the controller 2150 may measure the load amount by directly measuring a voltage and a current applied to a load. In this case, the controller 2150 may contain a voltmeter and an ammeter for a secondary-side circuit connected to the load. Alternatively, the controller 2150 may calculate the load amount by sensing input power from a power supply and measuring the voltage or the current applied to the load. In addition to the methods described above, various methods for sensing a load amount used in several power conversion devices in the art may be applied to the controller 2150.

The controller 2150 controls the transfer device 2140 depending on the load amount of the load. In detail, the controller 2150 may control the transfer device 2140 so that the zone 2121 or 2122 having different permeabilities may occupy the air-gap area depending on the load amount.

The controller 2150 may be implemented in various schemes. For example, the controller 2150 may be at least one of a processor, an application specific integrated circuit (ASIC), an embedded processor, a microprocessor, a hardware control logic, a hardware finite state machine (FSM), and a digital signal processor (DSP).

Figure 22:
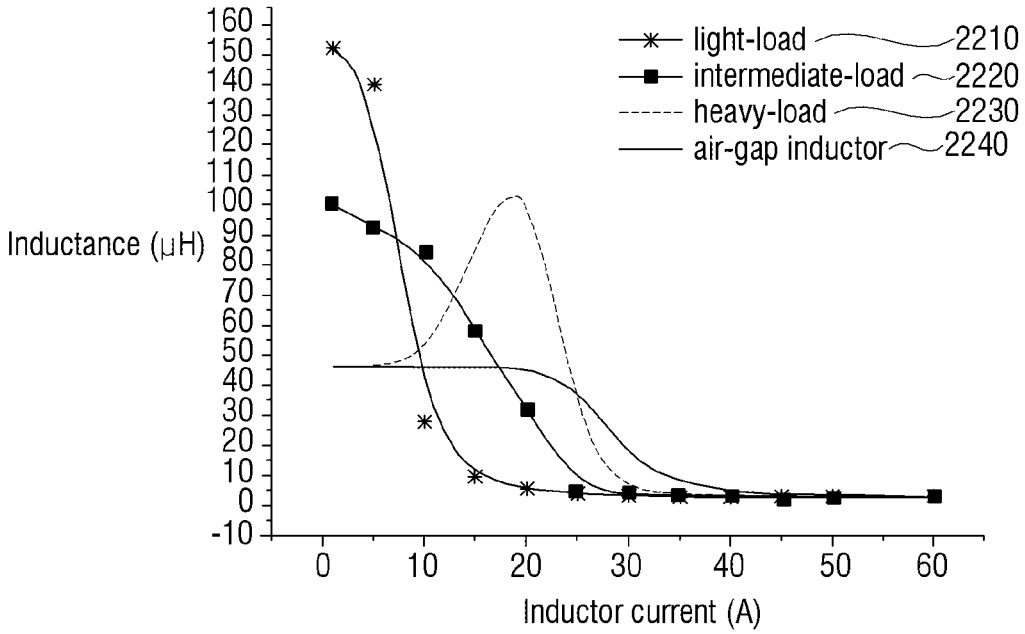
FIG. 22 is a graph for describing inductance characteristics of the inductor of FIG. 21.

FIG. 22 is a graph for describing inductance characteristics of the inductor of FIG. 21.

Referring to FIG. 22, graphs representing an inductance change curve 2240 of a general air-gap inductor, an inductance change curve 2210 of an inductor in a light-load, an inductance change curve 2220 of an inductor in an intermediate-load, and an inductance change curve 2230 of an inductor in a heavy-load with respect to an inductor current are illustrated.

The inductor in which the second magnetic region positioned in the air-gap can move by the transfer device has high inductance characteristics as compared with the general inductor having the air-gap. In addition, the inductor in which the second magnetic region can move may have different inductance characteristics depending on a magnitude of the load.

Although exemplary embodiments of the present disclosure has been described hereinabove, the present disclosure is not limited thereto, but may be variously modified and altered by those skilled in the art to which the present disclosure pertains without departing from the spirit and scope of the present disclosure claimed in the claims. These modifications and alterations are to fall within the scope of the present disclosure.

What is claimed is:

1. An inductor comprising:

a magnetic core; and a coil part surrounding a portion of the magnetic core and generating a magnetic flux depending on a flow of current, wherein the magnetic core includes a first magnetic region formed of a first magnetic material and a second magnetic region formed of a second magnetic material different from the first magnetic material, wherein the second magnetic region includes a plurality of magnetic component and a non-magnetic material, wherein the plurality of magnetic components are arranged as a plurality of layers in the non-magnetic material, and wherein the plurality of magnetic components are included in a predetermined fixed region of the non-magnetic material.

2. The inductor as claimed in claim 1, wherein the plurality of magnetic components are arranged with a predetermined interval.

3. The inductor as claimed in claim 1, wherein a total volume of the plurality of magnetic components and volume of the non-magnetic material have a predetermined ratio.

4. The inductor as claimed in claim 1, wherein the plurality of magnetic components are at least one of magnetic strips and magnetic powders.

5. The inductor as claimed in claim 1, wherein the second magnetic region includes a plurality of zones having different permeabilities.

6. The inductor as claimed in claim 5, wherein the second magnetic region has a shape in which the plurality of zones are arranged in a direction parallel to the magnetic flux passing through the second magnetic region.

7. The inductor as claimed in claim 5, wherein the second magnetic region has a shape in which the plurality of zones are arranged in a direction perpendicular to the magnetic flux passing through the second magnetic region.

8. The inductor as claimed in claim 7, wherein the plurality of zones are arranged in one continuous space, or arranged in a plurality of spaces separated from each other, respectively.

9. The inductor as claimed in claim 7, wherein the plurality of zones move to be misaligned from an area of the first magnetic region in the magnetic core.

10. The inductor as claimed in claim 9, wherein the second magnetic region is configured so that only some of the plurality of zones thereof occupy the area.

11. The inductor as claimed in claim 9, further comprising:

a transfer device moving the plurality of zones; and a controller controlling the transfer device to move the plurality of zones depending on an amount of load connected to a secondary side of a power conversion circuit.

12. A method for manufacturing an inductor comprising:

providing a magnetic core;

forming an air-gap in one region of the provided magnetic core;

filling the formed air-gap with a second magnetic material different from a first magnetic material of the magnetic core; and winding a coil around a portion of the magnetic core filled with the different magnetic material, wherein the second magnetic material includes a plurality of magnetic components and a non-magnetic material, wherein the plurality of magnetic components are arranged as a plurality of layers in the non-magnetic material, and wherein the plurality of magnetic components are included in a predetermined fixed region of the non-magnetic material.

* * * * *